US012624856B2

(12) United States Patent
Kim et al.

(10) Patent No.: US 12,624,856 B2
(45) Date of Patent: May 12, 2026

(54) AIR CONDITIONER AND METHOD FOR CONTROLLING AN AIR CONDITIONER

(71) Applicant: LG ELECTRONICS INC., Seoul (KR)

(72) Inventors: Beomchan Kim, Seoul (KR); Sungoh Choi, Seoul (KR); Hyeri Park, Seoul (KR); Jusu Kim, Seoul (KR); Hyungsoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 246 days.

(21) Appl. No.: 18/504,347

(22) Filed: Nov. 8, 2023

(65) Prior Publication Data

US 2024/0175599 A1 May 30, 2024

(30) Foreign Application Priority Data

Nov. 24, 2022 (KR) ..... 10-2022-0159599

(51) Int. Cl.
*F24F 11/84* (2018.01)

(52) U.S. Cl.
CPC ..... *F24F 11/84* (2018.01)

(58) Field of Classification Search
CPC ..... F24F 1/0059; F24F 11/84; F25B 13/00; F25B 39/028; F25B 39/02; F25B 41/20;
(Continued)

(56) References Cited

U.S. PATENT DOCUMENTS

2014/0083126 A1* 3/2014 Shimazu ..... F25B 49/00 62/324.6
2018/0283584 A1* 10/2018 Hong ..... F16L 9/17
(Continued)

FOREIGN PATENT DOCUMENTS

JP 09-126598 5/1997
JP 3215614 B2 * 10/2001 ..... F25B 43/02
(Continued)

OTHER PUBLICATIONS

Katsumi, Refrigeration Cycle And Refrigeration Cycle Parts For Air Conditioners, Oct. 9, 2001, JP 3215614 B2, Whole Document (Year: 2001).*
Korean Office Action issued in Application No. 10-2022-0159599 dated Feb. 21, 2025.
(Continued)

*Primary Examiner* — Elizabeth J Martin
*Assistant Examiner* — Adam Dorrel Moore
(74) *Attorney, Agent, or Firm* — KED & ASSOCIATES

(57) ABSTRACT

An air conditioner and a method for controlling an air conditioner are provided. The air conditioner includes an outdoor unit including a compressor and a heat exchanger; and an indoor unit connected to the outdoor unit through a gas pipe and a liquid pipe and having a heat exchanger including first and second coils branched from the gas pipe in series. The indoor unit includes first and second manifolds connected by refrigerant pipes to enable refrigerant flow to the indoor heat exchanger, an expansion valve connected in parallel to the liquid pipe, a distributor in which expansion valves are connected in series and connected by a refrigerant pipe to enable refrigerant flow to the first coil, a refrigerant flow pipe that connects the first manifold and the second coil, a gas-liquid separator installed in the refrigerant flow pipe to phase-separate the refrigerant, a bypass pipe installed between the gas pipe and the gas-liquid separator, and a control valve installed on the gas pipe.

13 Claims, 10 Drawing Sheets

(58) Field of Classification Search
CPC ..... F25B 41/31; F25B 41/40; F25B 43/00; F25B 49/02; F25B 2313/02741; F25B 2400/0403; F25B 2600/2515
See application file for complete search history.

(56) References Cited

U.S. PATENT DOCUMENTS

| | | | | |
|---|---|---|---|---|
| 2021/0254875 | A1* | 8/2021 | Arensmeier | F25B 41/20 |
| 2022/0268501 | A1* | 8/2022 | Subrahmanya | F25B 39/028 |
| 2024/0369272 | A1* | 11/2024 | Tsukiyama | F25B 1/00 |

FOREIGN PATENT DOCUMENTS

| | | |
|---|---|---|
| JP | 2017-058101 | 3/2017 |
| JP | 2021-014930 | 2/2021 |
| KR | 10-1996-0024150 | 7/1996 |
| KR | 10-2005-0118450 | 12/2005 |
| KR | 10-2007-0031712 | 3/2007 |
| KR | 10-2021-0108240 | 9/2021 |
| WO | WO 2020/070892 | 4/2020 |

* cited by examiner

AIR CONDITIONER AND METHOD FOR CONTROLLING AN AIR CONDITIONER

CROSS-REFERENCE TO RELATED APPLICATION(S)

This application claims priority under 35 U.S.C. § 119 to Korean Application No. 10-2022-0159599, filed in Korea on Nov. 24, 2022, whose entire disclosure is hereby incorporated by reference.

BACKGROUND

1. Field

An air conditioner and a method for controlling an air conditioner are disclosed herein.

2. Background

In general, an air conditioner uses a refrigerant cycle including a compressor, a condenser, an expansion device, and an evaporator, for example, to cool or heat a room or purify air in order to create a more comfortable indoor environment for users. In particular, an air conditioner for cooling and heating a large indoor space may include an air handling unit (AHU), which is an indoor unit, and an outdoor unit.

The air handling unit is a ventilation combined air conditioning unit that mixes outdoor air with indoor air, heat-exchanges the mixed air in a heat exchanger, and then supplies the mixed air to a room, is installed in an air conditioning room, or machine room, for example, provided separately from the room where the air is conditioned among buildings or houses where the air conditioner is installed, and thus, it is possible to distribute a flow of air to each space through a duct.

The outdoor unit may supply refrigerant to a heat exchanger of an air handling unit using a refrigeration cycle and may include a compressor, a condenser, an expansion device, and an evaporator, for example, forming a refrigeration cycle.

Korean Patent Publication No. 2021-0108240, which is hereby incorporated by reference, discloses a related art unitary type air conditioner having a square frame and an A-COIL, a lower end of which is supported an upper side of the frame. The A-COIL includes a first coil and a second coil in the air handling unit so that refrigerant flows therein and air passing through the frame exchanges heat with the refrigerant to distribute conditioned air to a room. However, in such a unitary type air conditioner, efficient operation in a partial load cycle is impossible because the cycle is configured to focus on full load without responding to performance of the load during cooling and heating operations. In addition, it is necessary to improve efficiency of not only the full load cycle but also the partial load cycle in order to satisfy annual efficiency standards of Seasonal Energy Efficiency Ratio (SEER) and Heating Seasonal Performance Factor (HSPF) of North America.

BRIEF DESCRIPTION OF THE DRAWINGS

Embodiments will be described in detail with reference to the following drawings in which like reference numerals refer to like elements, and wherein.

DETAILED DESCRIPTION

Figure 1:
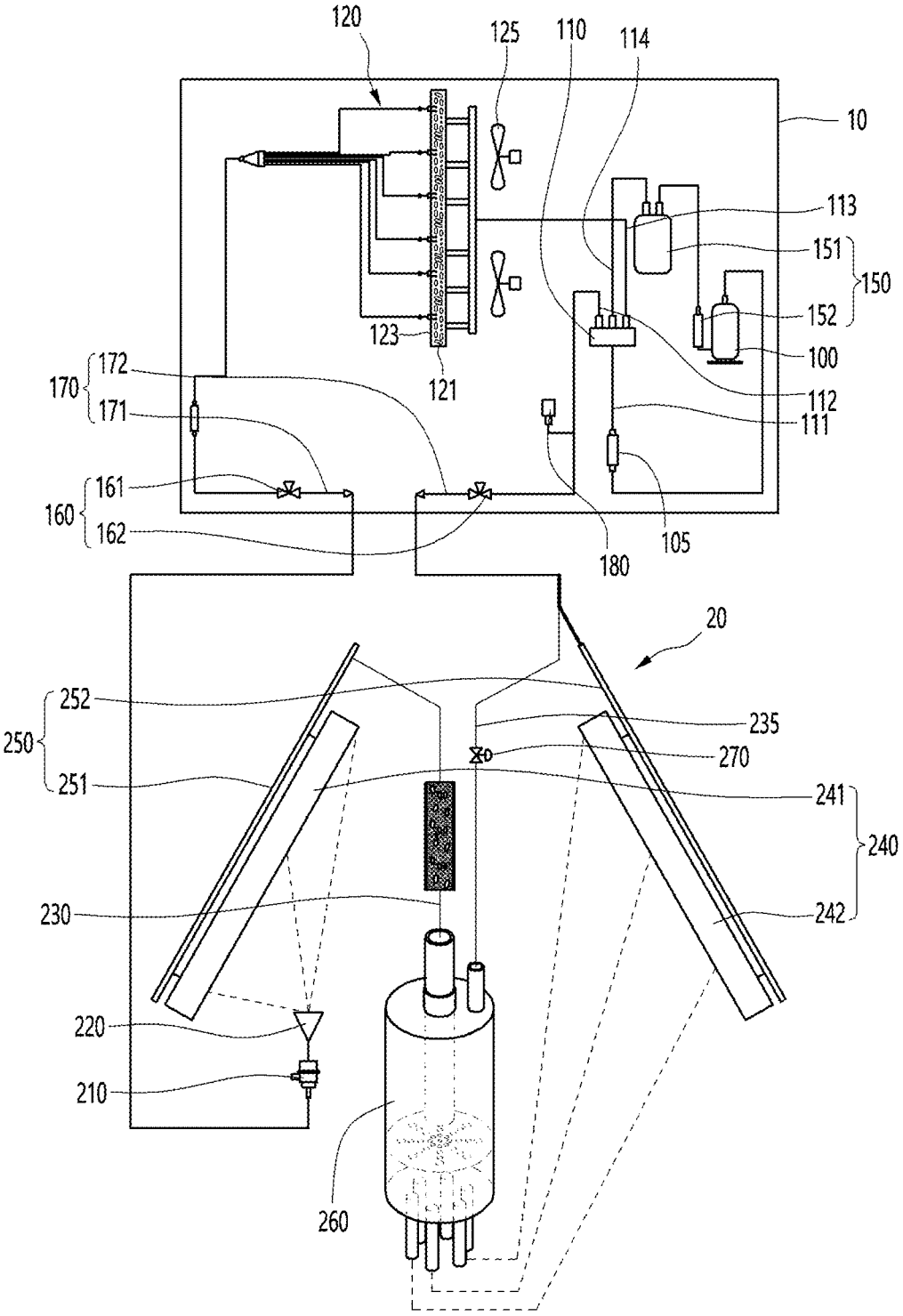
FIG. 1 is a schematic view of an air conditioner according to an embodiment.

Hereinafter, embodiments will be described with reference to the drawings. However, the embodiments are not limited to the disclosed embodiments, and those skilled in the art who understand the spirit can easily propose other embodiments included within the scope of the same spirit by adding, deleting, changing, and supplementing components but it will be said that this is also included within the scope of the spirit.

In adding reference numerals to components of each drawing, it should be noted that the same components have the same numerals as much as possible even if they are displayed on different drawings. In addition, in describing an embodiment, if it is determined that description of a related known configuration or function hinders understanding of the embodiment, description thereof is omitted.

Also, terms such as first, second, A, B, (a), (b) or the like may be used herein when describing components of the embodiment of the present disclosure. Each of these terminologies is not used to define an essence, order or sequence of a corresponding component but used merely to distinguish the corresponding component from other component(s). It should be noted that when a component is described as being "connected," "coupled," or "joined" to another component, that component may be directly connected or joined to the other component, but another component may be "connected", "coupled" or "joined" between each component.

FIG. 1 is a schematic view of an air conditioner according to an embodiment. An air conditioner according to an embodiment refers to a device for maintaining indoor air in a most suitable state according to use and purpose. More specifically, the air conditioner may perform ventilation by supplying conditioned air to an indoor space and exhausting polluted air from the indoor space. The air conditioner may include an outdoor unit 10 installed outdoors and an indoor unit 20 connected to the outdoor unit 10 and installed indoors. In particular, the air conditioner may be implemented as a separate type air conditioner in which the outdoor unit 10 and the indoor unit 20 are separated.

As illustrated in FIG. 1, an air conditioner according to an embodiment may include outdoor unit 10 and indoor unit 20 to operate a refrigerant cycle in which a refrigerant circulates. A plurality of pipes provided in the outdoor unit 10 and the indoor unit 20 through which the refrigerant circulates are referred to as refrigerant pipes.

The outdoor unit 10 according to an embodiment will be described hereinafter.

The outdoor unit 10 may include a compressor 100, a muffler 105, a flow control valve 110, an outdoor heat exchanger 120, a pressure sensor 180, and a gas-liquid separator 150. The compressor 100 is a device that compresses refrigerant, and based on a compression capacity, a refrigerating capacity of the air conditioner, in other words, an air conditioning capacity, may be determined. Air conditioning capacity may include cooling capacity or heating capacity.

More specifically, regarding the cooling capacity of the air conditioner, a minimum capacity may be 43 KW, a medium capacity may be 102 KW, and a maximum rated capacity may be 145 KW. In addition, in relation to the heating capacity of the air conditioner, a minimum capacity may be 44 KW, a medium capacity may be 95 kW, and a maximum rated capacity may be 167 kW.

The compressor 100 may include a rotary inverter compressor.

The muffler 105 may be disposed on or at an outlet side of the compressor 100. The muffler 105 may reduce noise generated from high-temperature and high-pressure refrigerant discharged from the compressor 100. The muffler 105 may include a chamber (not illustrated) that increases a flow cross-sectional area of the refrigerant, and the chamber may form a resonance chamber (not illustrated).

The flow control valve 110 may be disposed on or at an outlet side of the muffler 105 and change a flow direction of the refrigerant compressed in the compressor 100. The flow control valve 110 may include a four-way valve. For example, a four-way valve includes a plurality of ports. The plurality of ports may include first port 111, into which high-temperature and high-pressure refrigerant compressed by the compressor 100 flows, second port 112 connected to a pipe that extends from the flow control valve 110 toward the outdoor heat exchanger 120, third port 113 connected to a pipe that extends from the flow control valve 110 to the indoor unit 20, and fourth port 114 that extends from the flow control valve 110 to the gas-liquid separator 150.

The refrigerant compressed in the compressor 100 may flow into the flow control valve 110 through the first port 111 after passing through the muffler 105. When the air conditioner is in a cooling operation, the refrigerant flowing into the flow control valve 110 may flow to the outdoor heat exchanger 120. For example, the refrigerant may be discharged from the second port 112 of the flow control valve 110 and introduced into the outdoor heat exchanger 120. On the other hand, when the air conditioner is in a heating operation, the refrigerant flowing into the flow control valve 110 may flow to the indoor unit 20. For example, the refrigerant may be discharged from the third port 113 of the flow control valve 110 and flow into the indoor unit 20.

The outdoor heat exchanger 120 may be disposed on or at an outlet side of the flow control valve 110 to exchange heat with outside air and change refrigerant to a medium-temperature and high-pressure state. The outdoor heat exchanger 120 may include a heat exchange pipe 121 and a holder 123 that supports the heat exchange pipe 121. The holder 123 may support both sides of the heat exchange pipe 121. Although not illustrated in the drawings, the outdoor heat exchanger 120 may further include a heat exchange fin coupled to the heat exchange pipe 121 to assist heat exchange with outside air. A blowing fan 125 that supplies outside air to the outdoor heat exchanger 120 may be further included on or at one side of the outdoor heat exchanger 120.

The outdoor unit 10 may include a three-way valve 160 to which a connection pipe 170 may be connected when assembled with the indoor unit 20. The connection pipe 170 may be a pipe that connects the outdoor unit 10 and the indoor unit 20. In other words, the outdoor unit 10 and the indoor unit 20 may be connected through the connection pipe 170.

The three-way valve 160 may include first three-way valve 161 provided on a first side of the outdoor unit 10 and second three-way valve 162 provided on a second side of the outdoor unit 10. The connection pipe 170 may include first connection pipe 171 that extends from the first three-way valve 161 to the indoor unit 20 and second connection pipe 172 that extends from the second three-way valve 162 to the indoor unit 20. Accordingly, the first connection pipe 171 may be connected to a first side of the indoor unit 20 and the second connection pipe 172 may be connected to a second side of the indoor unit 20.

The first connection pipe 171 may be a liquid pipe through which liquid-phase refrigerant discharged from the compressor 100 or two-phase refrigerant in which liquid-phase and gas-phase are mixed may be supplied to the indoor unit 20. The second connection pipe 172 may be a gas pipe through which gas-phase refrigerant discharged from the compressor 100 may be supplied to the indoor unit 20.

The pressure sensor 180 may be installed in a refrigerant pipe that extends from the third port 113 of the flow control valve 110 to the second three-way valve 162. The pressure sensor 180 may detect pressure, in other words, high pressure, of the refrigerant compressed in the compressor 100.

The gas-liquid separator 150 may be disposed at an inlet side of the compressor 100 to separate gas-phase refrigerant from evaporated low-pressure refrigerant and provide the gas-phase refrigerant to the compressor 100. The gas-liquid separator 150 may include first gas-liquid separator 151 connected to the fourth port 114 of the flow control valve 110 and second gas-liquid separator 152 provided at an outlet side of the first gas-liquid separator 151 or the outlet side of the compressor 100. In other words, the second gas-liquid separator 152 may be disposed between the first gas-liquid separator 151 and the compressor 100. The first gas-liquid separator 151 may be referred to as a 'main gas-liquid separator' and the second gas-liquid separator 152 may be referred to as an 'auxiliary gas-liquid separator'.

The outdoor unit 10 may include a refrigerant pipe that extends from the fourth port 114 of the flow control valve 110 to the compressor 100. The first gas-liquid separator 151 and the second gas-liquid separator 152 may be installed in the refrigerant pipe. The gas-phase refrigerant separated by the gas-liquid separator 150 may be suctioned into the compressor 100.

The indoor unit 20 according to an embodiment will be described hereinafter.

The indoor unit 20 may include an expansion valve 210, a distributor 220, an indoor heat exchanger 240, a manifold device 250, a gas-liquid separator 260, and a control valve 270. In the indoor unit 20, the first connection pipe 171 of the first connection pipe 171 and the second connection pipe 172, which is a liquid pipe, disposed on an outlet side of the first three-way valve 161 and the second three-way valve 162 of the outdoor unit 101 is connected, and the expansion valve 210 connected from the first connection pipe 171 is provided.

The expansion valve 210 is connected to the refrigerant pipe to expand and depressurize refrigerant introduced from the liquid pipe. The expansion valve 210 may be installed in the outdoor unit 10 as in the related art; however, when installed in the outdoor unit 10, this is not advantageous because it overlaps with the indoor unit 20.

The distributor 220 connected to the expansion valve 210 correspondingly is provided at one side of the expansion valve 210. In addition, a first coil 241 of the indoor heat exchanger 240 may be connected to one side of the distributor 220 through a plurality of refrigerant supply pipes 237.

The distributor 220 distributes and supplies refrigerant flowing therein through the first connection pipe 171 to the first coil 241 of the indoor heat exchanger 240 through the flow path. The refrigerant flowing from the distributor 220 to the first coil 241 of the indoor heat exchanger 240 may flow through the plurality of refrigerant supply pipes 237.

The indoor heat exchanger 240 is a device that exchanges heat between air and refrigerant, and includes the first coil 241 and a second coil 242 in which the refrigerant flows and the air flowing inside exchanges heat with the refrigerant to distribute conditioned air to the room. The indoor heat exchanger 240 including the first coil 241 and the second coil 242 further includes a plurality of tubes (not illustrated) in which the refrigerant flows and a plurality of heat dissipation fins (not illustrated) coupled around the plurality of tubes to enable heat transfer to promote heat exchange between the plurality of tubes.

The plurality of tubes may be disposed in a zigzag shape in a vertical direction and connected in communication with each other, and a plurality of heat dissipation fins may be coupled at a predetermined pitch in a longitudinal direction of the plurality of tubes forming a row in the vertical direction.

The heat dissipation fin is a thermally conductive member and includes a plate (not illustrated) formed in a longitudinally-extending plate shape, a plurality of tube insertion holes formed to allow tubes to be inserted through a plate surface, and a plurality of slit fins (not illustrated) formed to promote heat transfer between the plurality of tube insertion holes.

The slit fins may be recessed from a first plate surface in a thickness direction of the plate, protrude toward a second plate surface, extend in a longitudinal direction of the plate, and be spaced apart from each other in a widthwise direction of the plate.

The first coil 241 and the second coil 242 configured in this way communicate with each manifold device 250 through refrigerant pipes. The manifold device 250 may include first manifold 251 and second manifold 252 formed in a shape of a straight rod with a hollow inside so that refrigerant may flow therethrough. The first manifold 251 and the second manifold 252 may be a size sufficient to cover a size of the indoor heat exchanger 240.

The first manifold 251 and the second manifold 252 may be provided in parallel to the first coil 241 and the second coil 242 of the indoor heat exchanger 240, respectively. During the cooling operation, the refrigerant flowing from the outdoor unit 10 through the first connection pipe 171, in other words, the liquid pipe, flows from the first coil 241 of the indoor heat exchanger 240 to the first manifold 251. On the other hand, during the heating operation, the refrigerant flowing from the outdoor unit 10 through the second connection pipe 172, in other words, the gas pipe, is discharged from the second manifold 252 to the second coil 242 of the indoor heat exchanger 240.

The first manifold 251 and the second manifold 252 of the manifold device 250 may face each other, lower portions thereof may have a wider separation width, and upper portions thereof may have a relatively narrower separation width than the lower portions, and thus, the first manifold 251 and the second manifold 252 may be inclined, respectively. In addition, the first coil 241 and the second coil 242 disposed side by side on the first manifold 251 and the second manifold 252 may also face each other in an inclined shape, respectively.

The gas pipe side of the first manifold 251 and the second coil 242 are provided with a refrigerant flow pipe 230, which is a refrigerant pipe through which the refrigerant flows, and the gas-liquid separator 260 that phase-separates the refrigerant is provided on the refrigerant flow pipe 230. In addition, a bypass pipe 235 is provided in which gas phase refrigerant separated in the gas-liquid separator 260 is bypassed between the second connection pipe 172, that is, the gas pipe, and the gas-liquid separator 260 to circulate the gas phase refrigerant to the outdoor unit 10 through the second connection pipe 172. The control valve 270 is provided on the bypass pipe 235 to block gas-phase refrigerant from being bypassed.

Figure 2:
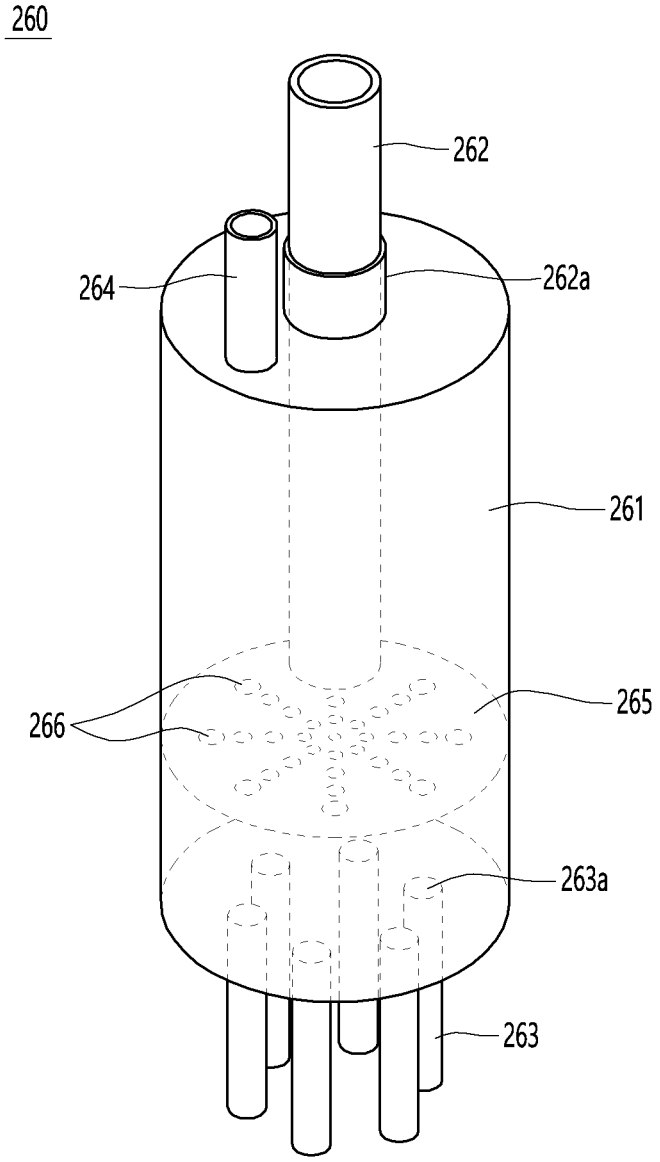
FIG. 2 is a perspective view of a gas-liquid separation device according to an embodiment.
Figure 3:
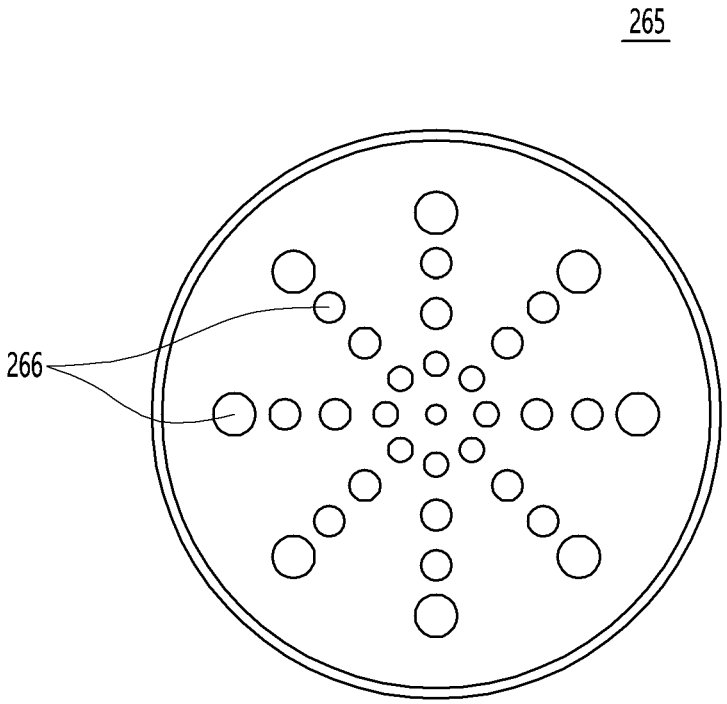
FIG. 3 is a plan view of a separator according to an embodiment.
Figure 4:
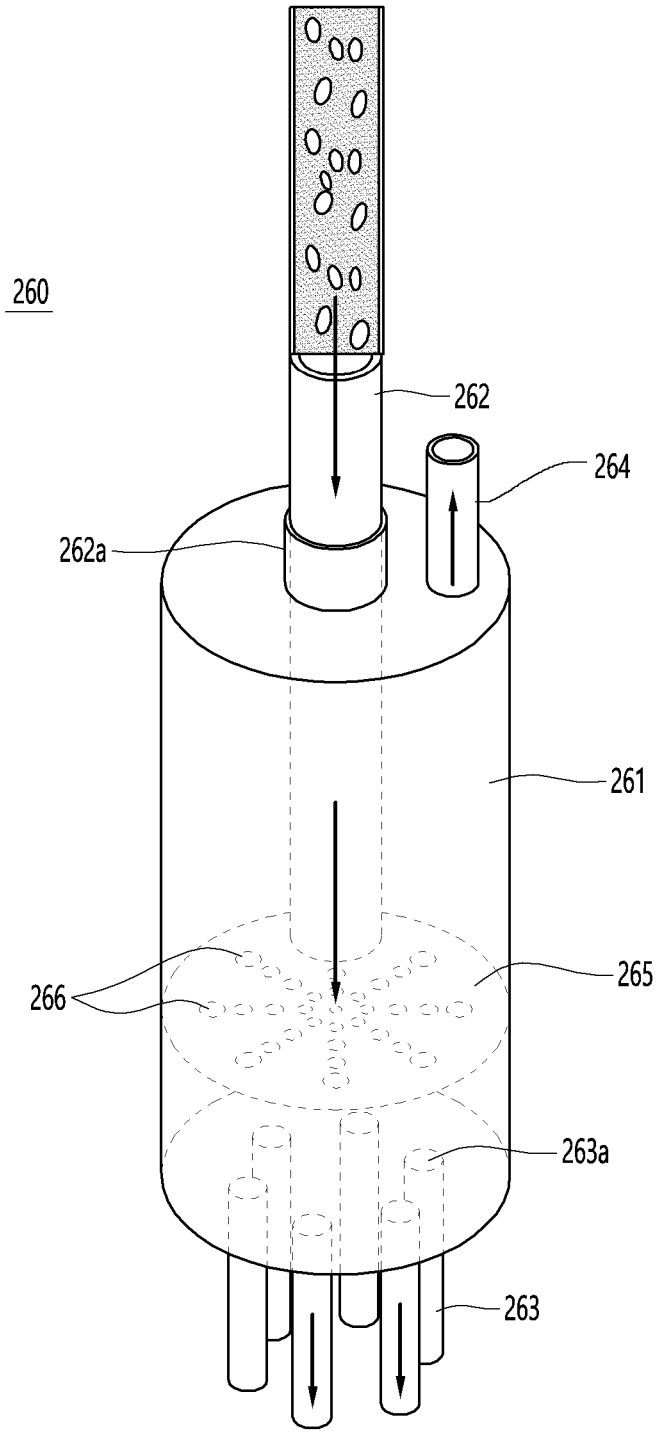
FIG. 4 is a perspective view illustrating a refrigerant flow structure of a gas-liquid separator according to an embodiment.

FIG. 2 is a perspective view of a gas-liquid separation device according to an embodiment. FIG. 3 is a plan view of a separator according to an embodiment. FIG. 4 is a perspective view illustrating a refrigerant flow structure of a gas-liquid separator according to an embodiment.

As illustrated in FIG. 2, the gas-liquid separator 260 may reduce pressure loss occurring under the cooling full load condition when the indoor heat exchanger 240 capable of series operation is applied through gas-liquid separation under the cooling full load condition. The pressure loss in the indoor heat exchanger 240 in the cooling full load condition is caused by the refrigerant in the gas-phase state. By separating the gas-phase refrigerant by a physical method, such as gas-liquid separation, the pressure loss in the indoor heat exchanger 240 may be minimized, and the problem of high load efficiency deterioration may be solved.

The gas-liquid separator 260 may include a main body 261, a refrigerant inflow pipe 262, a refrigerant discharge pipe 263, a bypass tube 264, and a separation plate 265. The main body 261 may be an airtight container having a space therein, and may have an inflow pipe installation hole 262*a* in which the refrigerant inflow pipe 262 may be installed, and a discharge pipe installation hole 263*a* in which the refrigerant discharge pipe 263 may be installed in a lower portion thereof. The refrigerant inflow pipe 262 may vertically extend and be installed in the inflow pipe installation hole 262*a* of the main body 261, and an upper end thereof may be exposed to the outside as it extends upward from the main body 261. In addition, a lower end of the portion extending into the refrigerant inflow pipe 262 may be located close to the separation plate 265.

A plurality of the refrigerant discharge pipe 263 may radially and vertically extend in the discharge pipe installation holes 263*a* of the main body 261, and a lower end exposed to the outside may extend downward from the main body 261. An upper end of each refrigerant discharge pipe 263 may be formed so as not to protrude above the discharge pipe installation hole 263*a* of the main body 261. In other words, when the refrigerant discharge pipe 263 protrudes above a bottom surface of the main body 261, the protruding portion acts as an obstruction in discharging refrigerant to prevent liquid-phase refrigerant from not being completely discharged and some remains.

The refrigerant inflow pipe 262 and the refrigerant discharge pipe(s) 263 are installed at a top and bottom of the main body 261, respectively, based on the separation plate 265 dividing the space into a first space and a second space by partitioning the space in a horizontal direction. The first space is an upper space above the separation plate 265 in which gas-phase refrigerant among liquid-phase and gas-phase mixed refrigerant introduced through the refrigerant inflow pipe 262 is present, and the second space is a lower space under the separator plate 265 where the separated liquid-phase refrigerant is present.

The bypass tube 264 may be installed in communication with the bypass pipe 235 connected between an outlet side of the second manifold 252 and the gas-liquid separator 260, and the gas-phase refrigerant separated inside of the main body 261 may be bypassed.

Lower ends of the refrigerant inflow pipe 262 and the bypass tube 264 accommodated in the main body 261 may be spaced apart from each other to improve gas-liquid separation efficiency. In other words, the farther a distance between the lower end of the refrigerant inflow pipe 262 and the lower end of the bypass tube 264 the more advantageous. If the distance is too close, gas-phase refrigerant is not bypassed through the bypass tube 264 and liquid-phase refrigerant among the two-phase refrigerant flowing into the refrigerant inflow pipe 262 may be bypassed, which is not advantageous.

As illustrated in FIG. 3, the separation plate 265 may have a disk shape fixed in the space of the main body 261 and may divide gas-phase and liquid-phase refrigerant among the two-phase refrigerant introduced through the refrigerant inflow pipe 262 into the first space and the second space. A plurality of through-hole(s) 266 may be provided in the separation plate 265. The through-holes 266 may be formed radially around through-hole 266 at a center of the separation plate 265. A diameter of the through-hole 266 may increase from the center to an edge of the separation plate 265 so that an amount of liquid-phase refrigerant discharged may be differentiated. This is to ensure that liquid-phase refrigerant discharged through the through-holes 266 at an edge side having a relatively large diameter is uniformly guided to the refrigerant discharge pipe 263 located on the edge side. With the gas-liquid separator 260 configured as described above, it is possible to reduce pressure loss in the indoor heat exchanger 240 that occurs under a cooling full load condition.

Operation of the gas-liquid separator 260 according to embodiments disclosed herein will be described with reference to FIG. 4.

Liquid-phase refrigerant flowing into the indoor unit 20 from the outdoor unit 10 passes through the expansion valve 210 to become refrigerant in a two-phase state, and the refrigerant in the two-phase state passes through the first coil 241 of the indoor heat exchanger 240 and the first manifold 251 of the manifold device 250, and flows through the refrigerant inflow pipe 230 to flow into the refrigerant inflow pipe 262 of the gas-liquid separator 260.

The two-phase refrigerant flowing into the refrigerant inflow pipe 262 collides with the separation plate 265 and diffuses in the first space of the main body 261. When the two-phase refrigerant diffuses in the first space, gas-phase refrigerant is suspended in the first space of the main body 261, and liquid-phase refrigerant having a relatively large mass is passed through the through-hole(s) 266 of the separation plate 265 to move to the second space. The liquid-phase refrigerant moved to the second space of the main body 261 flows to the second coil 242 of the indoor heat exchanger 240 through the refrigerant discharge pipe 263.

The indoor unit 20 may be connected to the outdoor unit 10 through the first connection pipe 171, in other words, the liquid pipe, and the second connection pipe 172, in other words, the gas pipe. A plurality of components of the outdoor unit 10 and the indoor unit 20 are connected by a refrigerant pipe, and the refrigerant pipe represents a path capable of guiding circulation of the refrigerant in the outdoor unit 10 and the indoor unit 20. It can be understood that the first connection pipe 171 and the second connection pipe 172 are included in the configuration of the refrigerant pipe.

Based on the configuration of the outdoor unit 10 and the indoor unit 20 configured as described above, a method for controlling an air conditioner according to embodiments disclosed herein will be described.

An air conditioner according to an embodiment performs an air conditioning operation of cooling and heating operations. The air conditioning operation is performed by selecting a full load (high load) operation and a partial load (low load) operation, respectively, by determining an operation rate of the compressor and the indoor load.

The configuration of the gas-liquid separator 260 in the air conditioner according to embodiments disclosed herein is to reduce pressure loss in the indoor heat exchanger 240 that occurs during the cooling full load operation, and the gas-liquid separator 260 may be applied only during the cooling full load operation. Refrigerant flows into the indoor unit 20 through the first connection pipe 171 of the outdoor unit 10, that is, the liquid pipe, and the refrigerant circulates along the refrigerant circulation flow path of the indoor unit 20.

Figure 7:
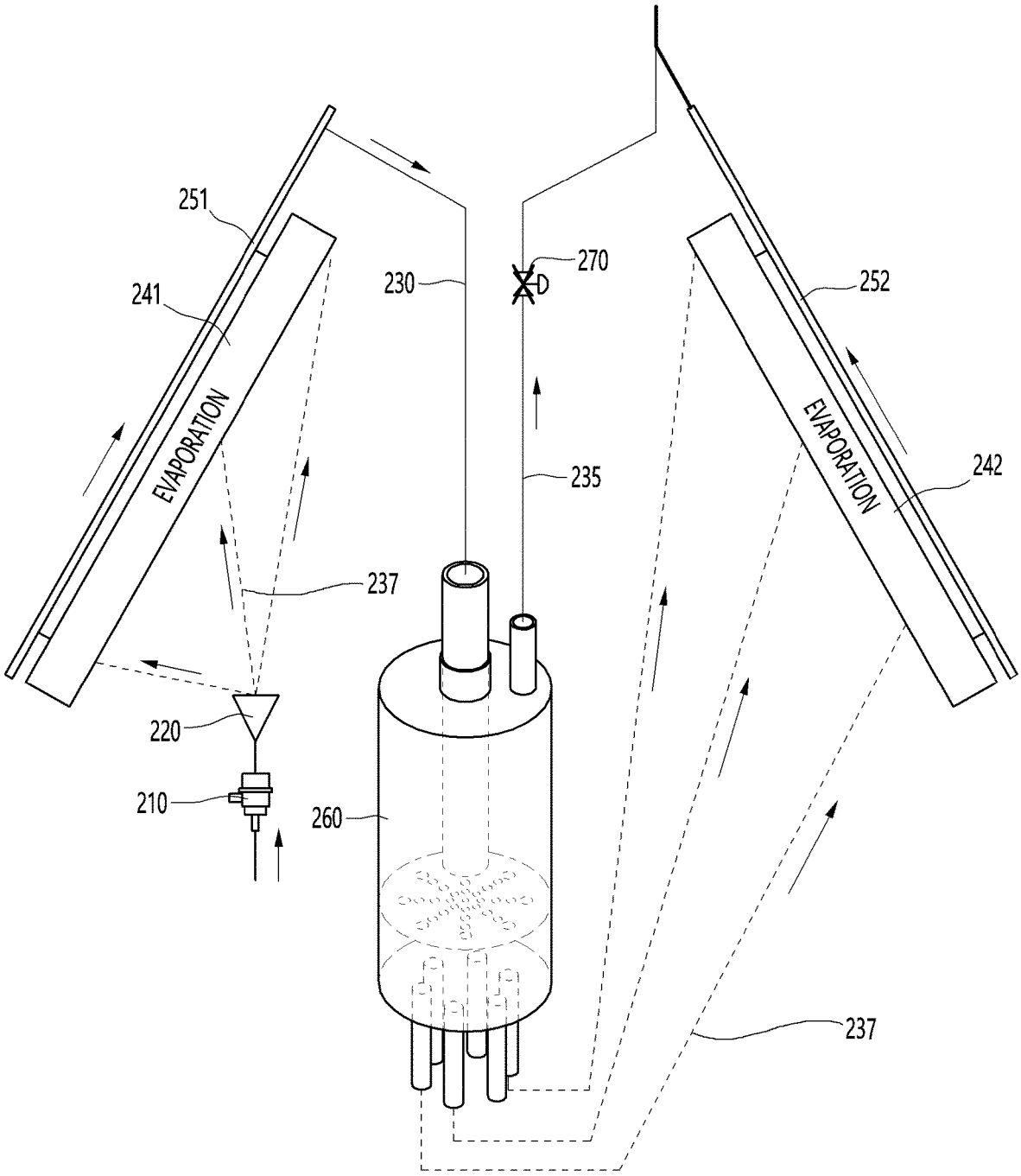
FIG. 7 is a schematic view illustrating a refrigerant cycle during a cooling partial load operation of an air conditioner according to an embodiment.

Prior to describing the refrigerant cycle of the air conditioner according to embodiments disclosed herein, among the valves illustrated in the drawing, the control valve 270 indicated by 'X' in FIG. 7 indicates a state in which a flow of refrigerant is blocked, and it can be understood that the flow of the refrigerant is impossible.

Figure 5:
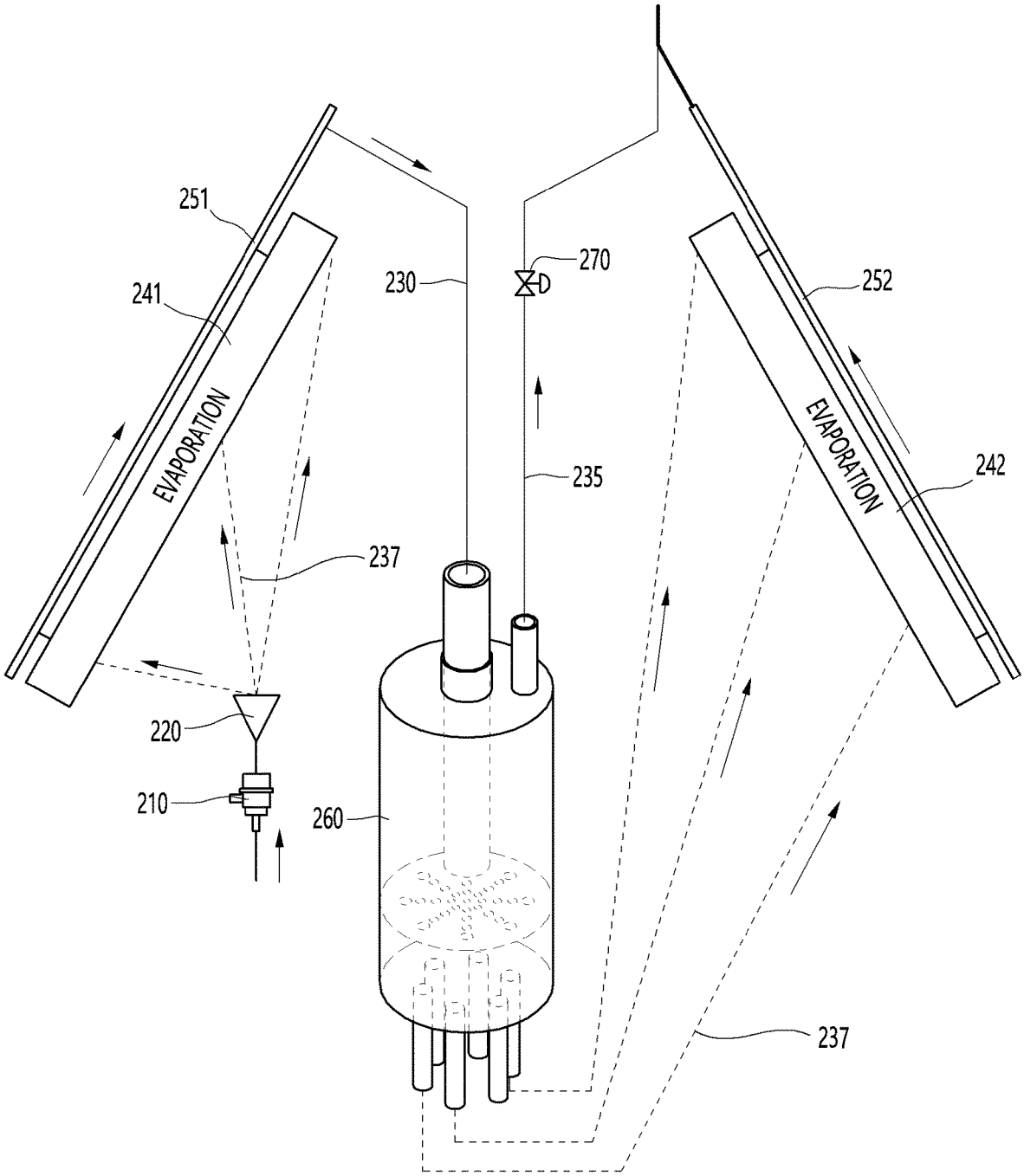
FIG. 5 is a schematic view illustrating a refrigerant cycle during a cooling full load operation of an air conditioner according to an embodiment.
Figure 6:
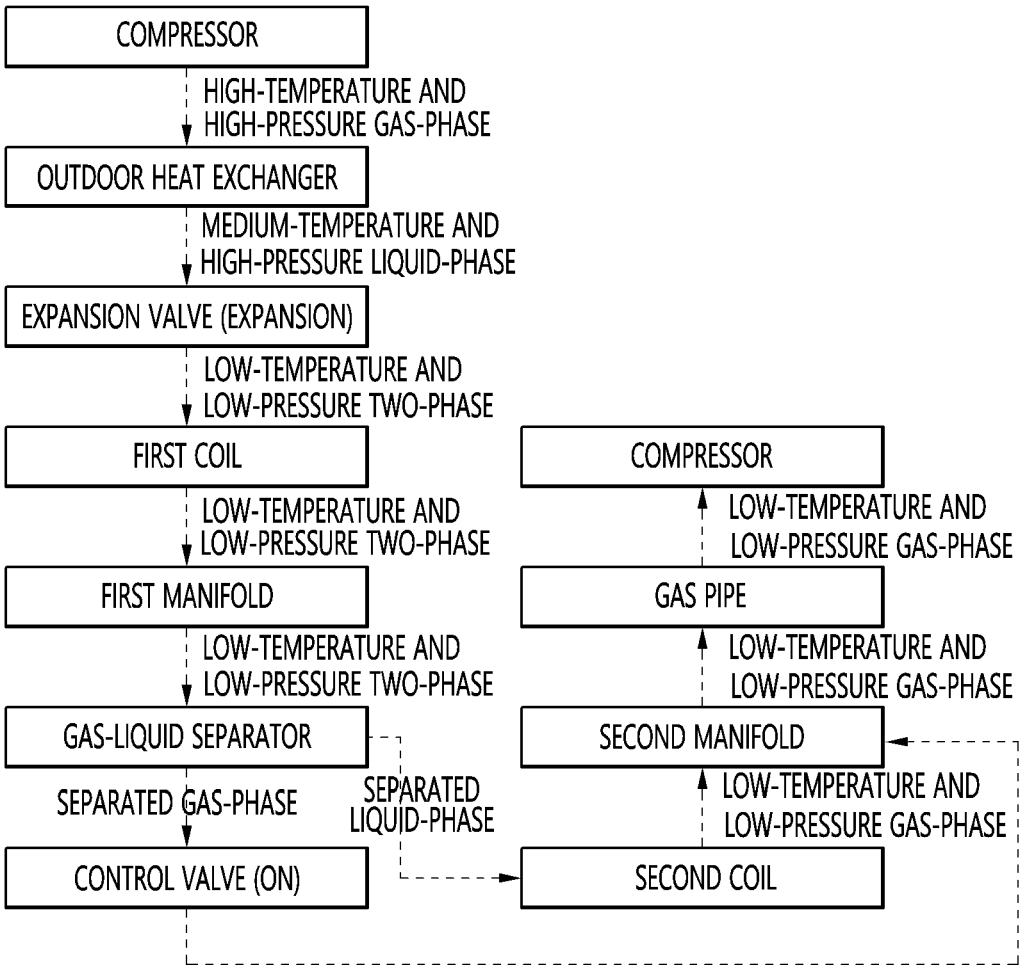
FIG. 6 is a flowchart illustrating a cooling full load operation logic of an air conditioner according to an embodiment.

FIG. 5 is a schematic view illustrating a refrigerant cycle during a cooling full load operation of an air conditioner according to an embodiment. FIG. 6 is a flowchart illustrating a cooling full load operation logic of an air conditioner according to an embodiment. Referring to FIGS. 5 and 6, the flow of refrigerant during the cooling full load operation logic of the air conditioner will be described hereinafter.

High-temperature and high-pressure gas-phase refrigerant discharged from the compressor 100 of the outdoor unit 10 passes through the outdoor heat exchanger 120 and is condensed to become medium-temperature and high-pressure liquid-phase refrigerant. The liquid-phase refrigerant is supplied to the indoor unit 20 through the first connection pipe 171.

The liquid-phase refrigerant supplied into the indoor unit 20 through the first connection pipe 171 is expanded by the expansion valve 210 to become low-temperature, low-pressure, two-phase refrigerant with low dryness. The two-phase refrigerant that expands in the expansion valve 210 and flows to the distributor 220 passes through the first coil 241 of the indoor heat exchanger 240.

The refrigerant may be evaporated while flowing through the first coil 241. Accordingly, as the liquid-phase refrigerant among the two-phase refrigerant in which the liquid-phase and the gas-phase are mixed partially evaporates, two-phase refrigerant having high dryness exists. In other words, the refrigerant in the gas-phase state is higher than the refrigerant in the liquid state, and the dryness is high.

The two-phase refrigerant flows to the first manifold 251 through the refrigerant pipe and flows to the gas-liquid separator 260 through the refrigerant flow pipe 230. The refrigerant in the two-phase state flows into the first space inside of the main body 261 of the gas-liquid separator 260 through the refrigerant inflow pipe 262.

The two-phase refrigerant flowing into the first space of the main body 261 collides with the separation plate 265. Among the refrigerant colliding on the separation plate 265, the gas-phase refrigerant flows to the outlet side of the second manifold 252 through the bypass pipe 235 and then flows to the second connection pipe 172. The liquid-phase refrigerant passes through the refrigerant discharge pipe 263 and passes through the second coil 242 of the indoor heat exchanger 240.

The refrigerant may be evaporated while flowing through the second coil 242. Accordingly, the liquid-phase refrigerant is phase-changed into gas-phase refrigerant.

The phase-changed low-temperature, low-pressure gas-phase refrigerant passes through the second manifold 252 and circulates through the second connection pipe 172 to the outdoor unit 10. In this way, in a case of a cooling full load operation of the air conditioner according to an embodiment, in order to minimize the pressure loss in the indoor heat exchanger 240 caused by the refrigerant in the gas-phase state, the refrigerant in the gas-phase state is bypassed from the gas-liquid separator 260 to the outlet side of the second manifold 252 through the bypass pipe 235 without flowing the refrigerant in the gas-phase state to the second coil 242 of the indoor heat exchanger 240, and the evaporation operation in the second coil 242 of the indoor heat exchanger 240 is suppressed through the flow that is circulated to the outdoor unit 10 through the second connection pipe 172, so that pressure loss in the indoor unit 20 itself may be minimized.

This may obtain the same effect as the pressure loss reduction effect in the indoor unit having a conventional parallel indoor heat exchanger.

Figure 8:
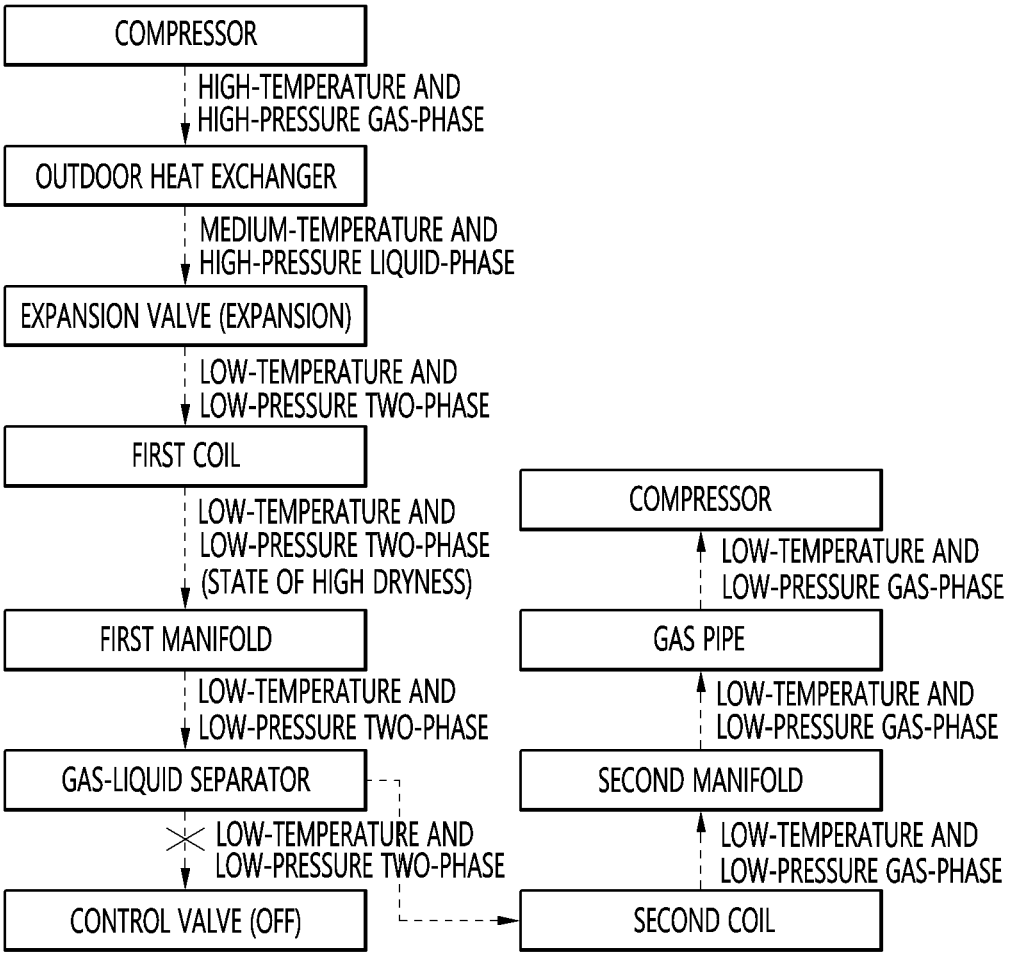
FIG. 8 is a flowchart illustrating a cooling partial load operation logic of an air conditioner according to an embodiment.

FIG. 7 is a schematic view illustrating a refrigerant cycle during a cooling partial load operation of an air conditioner according to an embodiment. FIG. 8 is a flowchart illustrating a cooling partial load operation logic of an air conditioner according to an embodiment. Referring to FIGS. 7 and 8, the flow of refrigerant during the cooling partial load operation logic of the air conditioner will be described hereinafter.

High-temperature and high-pressure gas-phase refrigerant discharged from the compressor 100 of the outdoor unit 10 passes through the outdoor heat exchanger 120 and is condensed to become medium-temperature and high-pressure liquid-phase refrigerant. The liquid-phase refrigerant is supplied to the indoor unit 20 through the first connection pipe 171.

The liquid-phase refrigerant supplied into the indoor unit 20 through the first connection pipe 171 is expanded by the expansion valve 210 to become low-temperature, low-pressure, two-phase refrigerant with low dryness. The two-phase refrigerant that expands in the expansion valve 210 and flows to the distributor 220 passes through the first coil 241 of the indoor heat exchanger 240.

The refrigerant may be evaporated while flowing through the first coil 241. However, among the two-phase refrigerant in which liquid-phase and gas-phase phase are mixed, the liquid-phase refrigerant evaporates first, but the evaporation amount is small, so that low-temperature, low-pressure two-phase refrigerant (two-phase refrigerant) with high dryness remains.

The two-phase refrigerant having such a high dryness flows to the first manifold 251 through the refrigerant pipe and flows to the gas-liquid separator 260 through the refrigerant flow pipe 230. At this time, as the control valve 270 is blocked, gas-liquid separation does not occur in the gas-liquid separator 260. Accordingly, the low-temperature and low-pressure two-phase refrigerant passes through the second coil 242 of the indoor heat exchanger 240 through the refrigerant discharge pipe 263 of the gas-liquid separator 260.

The refrigerant may be evaporated while flowing through the second coil 242. As a result, all of the liquid-phase refrigerant among the two phase refrigerant evaporates and is phase-changed into gas phase refrigerant. The phase-changed low-temperature, low-pressure gas-phase refrigerant passes through the second manifold 252 and circulates through the second connection pipe 172 to the outdoor unit 10.

In this way, in the case of the cooling partial load operation of the air conditioner according to an embodiment, as the refrigerant path is arranged in series from the expansion valve 210 to the second connection pipe 172, that is, the gas pipe, a length of the refrigerant path is relatively longer than in the case of the cooling full load operation. Accordingly, as a flow rate of the refrigerant increases and a heat transfer coefficient increases, energy efficiency may be maximized under a cooling condition with a small load.

Further, in the cooling operation of the air conditioner, when the indoor temperature reaches a set temperature or when a load of the compressor is reduced to be switched to the partial load operation, the pressure drop of the indoor heat exchanger 240 is not large. In addition, as the indoor heat exchanger 240 is arranged in series and the refrigerant path is arranged in series from the expansion valve 210 to the second connection pipe 172, that is, the gas pipe, the length of the refrigerant path becomes longer than the parallel arrangement structure of the conventional indoor heat exchanger. Accordingly, as the flow rate of the refrigerant increases and the heat transfer coefficient increases, energy efficiency may be maximized under a cooling condition with a small load.

Figure 9:
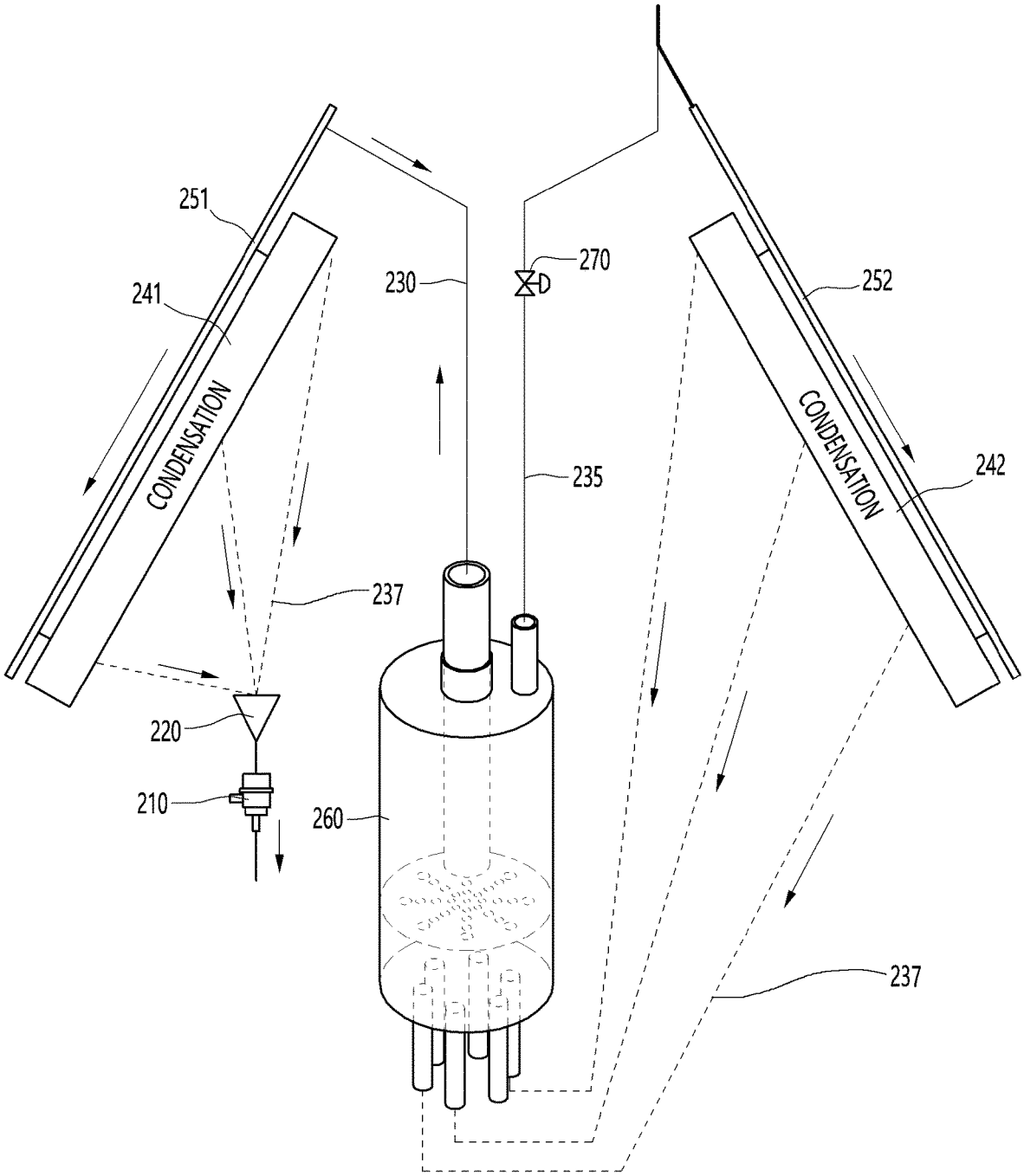
FIG. 9 is a schematic view illustrating a refrigerant cycle during a heating operation of an air conditioner according to an embodiment.
Figure 10:
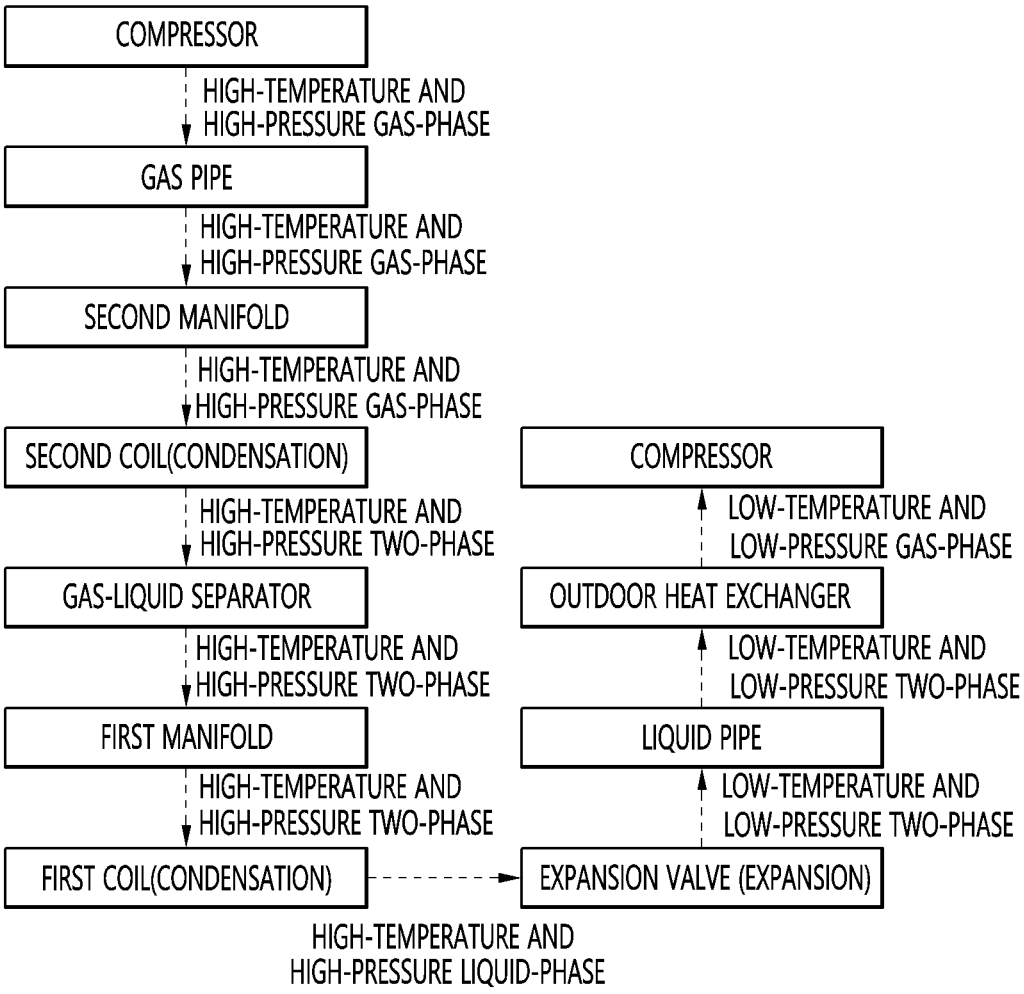
FIG. 10 is a flowchart illustrating a heating operation logic of an air conditioner according to an embodiment.

FIG. 9 is a schematic view illustrating a refrigerant cycle during a heating operation of an air conditioner according to an embodiment. FIG. 10 is a flowchart illustrating a heating operation logic of an air conditioner according to an embodiment. Referring to FIGS. 9 and 10, a flow of refrigerant during the heating operation logic of the air conditioner will be described hereinafter.

High-temperature and high-pressure gas-phase refrigerant discharged from the compressor of the outdoor unit 10 passes through the second connection pipe 172 of the outdoor heat exchanger 120, that is, the gas pipe, and is supplied to the indoor unit 20. The high-temperature and high-pressure gas-phase refrigerant supplied to the indoor unit 20 is supplied to the second manifold 252, and the refrigerant supplied to the second manifold 252 passes through the second coil 242 of the indoor heat exchanger 240 via the refrigerant pipe.

The refrigerant may be condensed while flowing through the second coil 242. Accordingly, the high-temperature and high-pressure gas-phase refrigerant is phase-changed into high-temperature and high-pressure two-phase refrigerant.

The high-temperature and high-pressure two-phase refrigerant supplied to the second coil 242 of the indoor heat exchanger 240 flows to the first manifold 251 via the gas-liquid separator 260 and the refrigerant flow pipe 230. The refrigerant that proceeds to the first manifold 251 proceeds to the first coil 241 of the indoor heat exchanger 240 through the refrigerant pipe.

The refrigerant may be condensed while flowing through the first coil 241. Accordingly, the high-temperature and high-pressure two-phase refrigerant is phase-changed into high-temperature and high-pressure liquid-phase refrigerant. The refrigerant passes through the first coil 241 and proceeds to the expansion valve 210 through the distributor 220. The refrigerant proceeding to the expansion valve 210 expands and depressurizes in the expansion valve 210, so that the high-temperature and high-pressure liquid-phase refrigerant becomes low-temperature and low-pressure two-phase refrigerant, and the outdoor unit 10 passes through the first connection pipe 171, that is, the liquid pipe to circulate to the outdoor unit 10. At this time, through the outdoor heat exchanger 120 of the outdoor unit 10, the refrigerant is phase-changed into low-temperature, low-pressure gas-phase refrigerant and flows into the compressor 100.

In this way, in the case of the heating operation of the air conditioner according to an embodiment, as the indoor heat exchangers 240 are arranged in series, and at the same time, the refrigerant path from the second connection pipe 172, that is, the gas pipe to the first connection pipe 171, that is, the liquid pipe is arranged in series up to the liquid pipe, the length of the refrigerant path becomes longer compared to the parallel arrangement structure of the conventional indoor heat exchanger. Accordingly, as the flow rate of the refrigerant increases and the heat transfer coefficient increases, it is possible to improve heating performance by maximizing energy efficiency in heating conditions.

Therefore, the indoor heat exchanger 240 capable of serial operation according to full load and partial load cycles during the cooling and heating operations of the air conditioner according to embodiments is applied, thereby maximizing energy efficiency according to operation load.

Further, the indoor heat exchanger 240 of the air conditioner is connected to allow serial operation, and by applying phase separation technology for the refrigerant to the indoor heat exchanger 240, the pressure loss generated in the indoor heat exchanger 240 under the cooling full load condition may be reduced.

Furthermore, by increasing a diameter of the plurality of through-holes 266 formed in the separation plate 265 in the gas-liquid separator 260 applied to the air conditioner from the center of the separation plate 265 toward the outside, uniform distribution of the refrigerant to the refrigerant discharge pipe 263 may be promoted.

Therefore, embodiments disclosed herein have been made to solve the above problems, and thus, embodiments disclosed herein provide an air conditioner which is capable of maximizing energy efficiency depending on the operation load by implementing an indoor heat exchanger capable of serial operation according to full load and partial load cycles during cooling and heating operation, and a method for controlling an air conditioner.

Further, embodiments disclosed herein provide an air conditioner which is capable of solving the problem of high load efficiency degradation by applying phase separation technology for refrigerant to the indoor heat exchanger in order to reduce the pressure loss occurring in the cooling full load condition when the indoor heat exchanger capable of serial operation is applied, and a method for controlling an air conditioner.

Furthermore, embodiments disclosed herein provide an air conditioner which promotes uniform distribution of refrigerant to the refrigerant discharge pipe by increasing the diameter of a plurality of through-holes formed in the separation plate in the gas-liquid separator in an outward direction from the center of the separation plate and a method for controlling an air conditioner.

Embodiments disclosed herein provide an air conditioner that may include an outdoor unit including a compressor and an outdoor heat exchanger, and an indoor unit connected to the outdoor unit through a gas pipe and a liquid pipe and having an indoor heat exchanger including a first coil and a second coil which are branched from the gas pipe and connected in series. In such an air conditioner, the indoor unit may maximize energy efficiency according to the operation load by disposing indoor heat exchangers in a serial structure, and by applying phase separation technology for refrigerant to an indoor heat exchanger capable of serial operation, pressure loss may be reduced under cooling full load conditions.

In addition, the indoor unit may include a first manifold and a second manifold connected by refrigerant pipes to enable refrigerant flow to the indoor heat exchanger, an expansion valve connected in parallel to the liquid pipe and that blocks the flow of refrigerant or expands the refrigerant to reduce a pressure thereof, a distributor in which expansion valves are connected in series and connected by a refrigerant pipe to enable refrigerant flow to the first coil, a refrigerant flow pipe connecting the gas pipe side of the first manifold and the second coil, gas-liquid separator installed on the refrigerant flow pipe to phase-separate the refrigerant, a bypass pipe installed between the gas pipe and the gas-liquid separator to bypass the gas-phase refrigerant separated in the gas-liquid separator and circulate the gas-phase refrigerant to the outdoor unit through the gas pipe, and a control valve installed on the gas pipe to block the flow of refrigerant.

According to the indoor heat exchanger according to embodiments disclosed herein, the first coil and the second coil may face each other, and lower portions thereof may have a wider separation width and upper portions thereof may have a relatively narrower separation width than the lower portions, and thus, the first coil and the second coil may be inclined, respectively. In addition, the first manifold and the second manifold may be disposed side by side with the first coil and the second coil and may communicate with each other through a refrigerant pipe.

During the cooling operation of the air conditioner, the first coil and the second coil may operate as an evaporator. During the heating operation of the air conditioner, the first coil and the second coil may operate as a condenser.

According to embodiments disclosed herein, refrigerant flowing from the distributor to the first coil and refrigerant flowing from the gas-liquid separator to the second coil may flow through a plurality of refrigerant supply pipes. The control valve may block the flow of refrigerant when the air conditioner is in cooling partial load operation.

During the cooling operation of the air conditioner, the refrigerant flowing therein from the outdoor unit through the liquid pipe may sequentially pass through the first coil, the first manifold, the gas-liquid separator, the second coil, and the second manifold to be circulated to the gas pipe. During the heating operation of the air conditioner, the refrigerant flowing into from the outdoor unit through the gas pipe may sequentially pass through the second manifold, the second coil, the gas-liquid separator, the first manifold, and the first coil to be circulated to the liquid pipe.

During the cooling operation of the air conditioner, low-temperature, low-pressure, two-phase refrigerant phase-changed in the expansion valve is in a low-dryness state, and the low-temperature, low-pressure, two-phase refrigerant flowing in the first coil evaporates and may be in a state of high dryness.

The gas-liquid separator may include a main body; a refrigerant inflow pipe through which a two-phase refrigerant flows into an upper portion of the main body; a refrigerant discharge pipe through which gas-phase refrigerant is discharged to a lower portion of the main body; a separation plate which is installed in the main body to divide the main body into a first space and a second space, in which a through-hole is provided, and which separates gas phase and liquid-phase refrigerants among the two-phase refrigerants flowing therein through the refrigerant inflow pipe to the first space and the second space, respectively; and a bypass tube installed in communication with the bypass pipe and bypassing the separated gas-phase refrigerant. Lower ends of the refrigerant inflow pipe and the bypass tube may be installed spaced apart from each other, and the lower end of the refrigerant inflow pipe may be located close to the separation plate and the lower end of the bypass tube may be located close to the upper portion of the main body.

The separation plate may have a disk shape fixed in the main body, and may distribute gas-phase refrigerant to the first space and liquid-phase refrigerant to the second space among the two-phase refrigerant flowing therein through the refrigerant inflow pipe. A plurality of through-holes may be formed in a radial direction around the through-hole at a center of the separation plate. The refrigerant to the refrigerant discharge pipe may be uniformly distributed by increasing diameters of the plurality of through-holes formed in the separation plate in the gas-liquid separator in an outward direction from the center of the separation plate.

Embodiments disclosed herein further provide a method for controlling an air conditioner including during a cooling full load operation and a cooling partial load operation of the air conditioner, phase-changing high-temperature and high-pressure gas-phase refrigerant discharged from a compressor of an outdoor unit into medium-temperature and high-pressure liquid-phase refrigerant in an outdoor heat exchanger of the outdoor unit and then flowing the liquid-phase refrigerant into an expansion valve of an indoor unit through a liquid pipe; flowing low-temperature, low-pressure two-phase refrigerant expanded and phase-changed by the expansion valve to a first coil through a refrigerant supply pipes, and flowing the refrigerant flowing into the first coil to the first manifold through the refrigerant pipe after evaporation; flowing the refrigerant flowing to the first manifold into a gas-liquid separator through a refrigerant flow pipe; flowing the refrigerant flowing to the gas-liquid separator to a second coil through a refrigerant discharge pipe; and evaporating the refrigerant flowing into the second coil to phase-change into a low-temperature, low-pressure gas-phase refrigerant, and circulating the phase-changed low-temperature, low-pressure gas-phase refrigerant through a second manifold and through a gas pipe to a compressor of an outdoor unit.

According to embodiments disclosed herein, during the cooling full load operation, the refrigerant flowing into the gas-liquid separator is phase-separated into liquid-phase and gas-phase, and the gas-phase refrigerant phase-separated into the gas phase flows toward the outlet side of the second manifold through the bypass pipe, and the liquid-phase refrigerant phase-separated into liquid-phase flows into the refrigerant discharge pipe. During the cooling partial load operation, the refrigerant flowing into the gas-liquid separator may flow into the refrigerant discharge pipe without phase separation.

Embodiments disclosed herein provide a method for controlling an air conditioner including, during a heating operation of the air conditioner, flowing high-temperature and high-pressure gas-phase refrigerant discharged from a compressor of an outdoor unit to a second manifold of an indoor unit through a gas pipe; flowing the refrigerant flowing to the second manifold to the second coil through a refrigerant pipe; condensing the refrigerant flowing into the second coil, phase-changing to high-temperature and high-pressure two-phase refrigerant, and then flowing to a first manifold through the gas-liquid separator and the refrigerant flow pipe through a refrigerant supply pipes; flowing the refrigerant flowing to the first manifold to a first coil, condensing the refrigerant flowing into the first coil, phase-changing to high-temperature and high-pressure liquid-phase refrigerant, and then flowing the refrigerant to an expansion valve; and expanding the refrigerant flowing to the expansion valve to phase-change to low-temperature and low-pressure two-phase refrigerant, phase-changing to low-temperature and low-pressure gas-phase refrigerant in the outdoor heat exchanger of the outdoor unit through a liquid pipe, and then circulating the refrigerant to the compressor.

According to an air conditioner and a method for controlling an air conditioner according to embodiments disclosed herein configured as described above, an indoor heat exchanger capable of serial operation according to full load and partial load cycles during cooling and heating operations of the air conditioner is implemented. Thus, there is an effect of maximizing energy efficiency according to operation load.

Further, by applying phase separation technology for the refrigerant to the indoor heat exchanger capable of serial operation, there is an effect of reducing pressure loss occurring in the cooling full load condition. Furthermore, by increasing diameters of the plurality of through-holes formed in the separation plate in the gas-liquid separator in an outward direction from the center of the separation plate, there is an effect of improving refrigerant distribution performance to the refrigerant discharge pipe.

The above description of embodiments is for illustrative purposes, and those skilled in the art may understand that it may be easily modified into other specific forms without changing the technical spirit or essential features. Therefore, the embodiments described above should be understood as illustrative in all respects and not limiting. The scope is indicated by the following claims, and all changes or modifications derived from the meaning and scope of the claims and equivalent concepts should be interpreted as being included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit including a compressor and an outdoor heat exchanger; and an indoor unit connected to the outdoor unit through a gas pipe and a liquid pipe and having an indoor heat exchanger including a first coil and a second coil which are branched from the gas pipe and connected in series, wherein the indoor unit further includes:

a first manifold and a second manifold connected by refrigerant pipes to enable refrigerant flow to the indoor heat exchanger, an expansion valve connected in parallel to the liquid pipe and configured to block flow of refrigerant or expand the refrigerant to reduce a pressure thereof, a refrigerant flow pipe connected to a gas pipe side of the first manifold and the second coil, a gas-liquid separator installed on the refrigerant flow pipe to phase-separate the refrigerant, a bypass pipe installed between the gas pipe and the gas-liquid separator to bypass the gas-phase refrigerant separated in the gas-liquid separator and circulate the gas-phase refrigerant to the outdoor unit through the gas pipe, and a control valve installed on the gas pipe to block the flow of refrigerant, wherein during a cooling full load operation of the air conditioner, the refrigerant flowing from the outdoor unit through the liquid pipe sequentially passes through the first coil, the first manifold, the gas-liquid separator, the second coil, and the second manifold to circulate to the gas pipe, wherein during the cooling full load operation of the air conditioner, the control valve is opened so that gas-liquid separation occurs in the gas-liquid separator, wherein during a cooling partial load operation of the air conditioner, the refrigerant flowing from the outdoor unit through the liquid pipe sequentially passes through the first coil, the first manifold, the gas-liquid separator, the second coil, and the second manifold to circulate to the gas pipe, and wherein during the cooling partial load operation of the air conditioner, the control valve is configured to block the flow of refrigerant so that gas-liquid separation does not occur in the gas-liquid separator.

2. The air conditioner of claim 1, wherein the indoor unit further comprises:

a distributor connected in series with the expansion valve and connected by a plurality of refrigerant supply pipes to the first coil.

3. The air conditioner of claim 2, wherein the refrigerant flowing from the distributor to the first coil and the refrigerant flowing from the gas-liquid separator to the second coil are configured to flow through the plurality of refrigerant supply pipes.

4. The air conditioner of claim 1, wherein the first coil and the second coil are configured to face each other, and wherein lower portions of the first coil and the second coil have a wider separation width than upper portions of the first coil and the second coil, and thus, the first coil and the second coil are inclined, respectively.

5. The air conditioner of claim 4, wherein the first manifold and the second manifold are disposed side by side with the first coil and the second coil and are configured to communicate with each other through a refrigerant pipe.

6. The air conditioner of claim 1, wherein first coil and the second coil are configured to operate as evaporators during a cooling operation of the air conditioner.

7. The air conditioner of claim 1, wherein the first coil and the second coil are configured to operate as condensers during a heating operation of the air conditioner.

8. The air conditioner of claim 1, wherein during a heating operation of the air conditioner, the refrigerant flowing from the outdoor unit through the gas pipe sequentially passes through the second manifold, the second coil, the gas-liquid separator, the first manifold, and the first coil to circulate to the liquid pipe.

9. The air conditioner of claim 1, wherein during a cooling operation of the air conditioner, two-phase refrigerant phase-changed in the expansion valve is in a first state of dryness, and wherein the two-phase refrigerant flowing in the first coil is evaporated to be in a second state of dryness.

10. The air conditioner of claim 1, wherein the gas-liquid separator includes:

a main body;

a refrigerant inflow pipe through which two-phase refrigerant flows into an upper portion of the main body;

at least one refrigerant discharge pipe through which liquid-phase refrigerant is discharged from a lower portion of the main body;

a separation plate which is installed in the main body to divide the main body into a first space and a second space, in which at least one through-hole is provided, and which separates gas phase and liquid-phase refrigerant among two-phase refrigerant flowing therein through the refrigerant inflow pipe to the first space and the second space, respectively; and a bypass tube that is installed in communication with the bypass pipe and bypasses the separated gas-phase refrigerant.

11. The air conditioner of claim 10, wherein a lower end of the refrigerant inflow pipe is positioned adjacent to the separation plate and a lower end of the bypass tube is positioned adjacent to an upper portion of the main body.

12. The air conditioner of claim 10, wherein the separation plate has a disk shape fixed in the main body, and distributes gas-phase refrigerant among the two-phase refrigerant flowing therein through the refrigerant inflow pipe to the first space and distributes liquid-phase refrigerant to the second space.

13. The air conditioner of claim 10, wherein the at least one through-hole comprises a plurality of through-holes formed in a radial direction around a central through-hole, and wherein a diameter of the plurality of through-holes increases from a center to an edge of the separation plate.

* * * * *